United States Patent [19]

Campbell et al.

[11] Patent Number: 4,854,955

[45] Date of Patent: Aug. 8, 1989

[54] HYDROCARBON GAS PROCESSING

[75] Inventors: Roy E. Campbell; John D. Wilkinson; Hank M. Hudson, all of Midland, Tex.

[73] Assignee: Elcor Corporation, Dallas, Tex.

[21] Appl. No.: 194,878

[22] Filed: May 17, 1988

[51] Int. Cl.[4] ..... F25J 3/02

[52] U.S. Cl. ..... 62/24; 62/32; 62/39; 62/42

[58] Field of Search ..... 62/23, 24, 32, 36, 38, 62/39, 42

[56] References Cited

U.S. PATENT DOCUMENTS

| | | | |
|---|---|---|---|
| 3,507,127 | 4/1970 | De Marco | 62/23 |
| 3,516,261 | 6/1970 | Hoffman | 62/24 |
| 3,656,311 | 4/1972 | Kaiser | 62/28 |
| 3,902,329 | 9/1975 | King, III et al. | 62/17 |
| 4,002,042 | 1/1977 | Pryor et al. | 62/28 |
| 4,004,430 | 1/1977 | Solomon et al. | 62/18 |
| 4,115,086 | 9/1978 | Jordan et al. | 62/28 |
| 4,132,604 | 1/1979 | Alexion et al. | 203/87 |
| 4,157,904 | 6/1979 | Campbell et al. | 62/27 |
| 4,171,964 | 10/1979 | Campbell et al. | 62/24 |
| 4,251,249 | 2/1981 | Gulsby | 62/28 |
| 4,278,457 | 7/1981 | Campbell et al. | 62/24 |
| 4,507,133 | 3/1985 | Khan et al. | 62/29 |
| 4,592,766 | 6/1966 | Kumman et al. | 62/18 |
| 4,596,588 | 6/1986 | Cook | 62/26 |
| 4,617,039 | 10/1986 | Buck | 62/26 |
| 4,657,571 | 4/1987 | Gazzi | 62/17 |
| 4,687,499 | 8/1987 | Aghili | 62/24 |
| 4,711,651 | 12/1987 | Sharma et al. . | |

FOREIGN PATENT DOCUMENTS 1259083 9/1986 U.S.S.R. .

*Primary Examiner*—Ronald C. Capossela

*Attorney, Agent, or Firm*—Brumbaugh, Graves, Donohue & Raymond

[57] ABSTRACT

A process for the recovery of propane and heavier hydrocarbon components from a hydrocarbon gas stream is disclosed. The stream is divided into first and second streams. The first stream is cooled to condense substantially all of it and is thereafter expanded to the pressure of the distillation column. After expansion, the cooled first stream is directed in heat exchange relation with a warmer distillation stream rising from fractionation stages of the distillation column. The warmed first stream is then supplied to the column at a first mid-column feed position. The second stream is expanded to the column pressure and is then supplied to the column at a second mid-column feed position. The distillation stream is cooled by the first stream sufficiently to partially condense it. The partially condensed distillation stream is then separated to provide volatile residue gas and a reflux stream. The reflux stream is supplied to the column at a top column feed position. The temperatures of the feeds to the column are effective to maintain the column overhead temperature at a temperature whereby the major portion of the $C_3+$ components is recovered. Alternatively, control means may be adapted so that the major portion of the $C_2+$ components is recovered.

28 Claims, 9 Drawing Sheets

NOTE: DATA POINTS BASED ON CONSTANT HORSEPOWER UTILIZATION (3678 HP) EXCEPT AS NOTED BY INDIVIDUAL DATA POINTS.

HYDROCARBON GAS PROCESSING

BACKGROUND OF THE INVENTION

This invntion relates to a process for the separation of a gas containing hydrocarbons.

Propane and heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e. methane and ethane together comprise at least 50 mole percent of the gas. The gas also contains relatively lesser amounts of heavier hydrocarbons such as propane, butanes, pentanes, and the like as well as hydrogen, nitrogen, carbon dioxide and other gases.

The present invention is generally concerned with the recovery of propane and heavier hydrocarbons from such gas streams. A typical analysis of a gas stream to be processed in accordance with this invention would be, in approximate mole percent, 86.9% methane, 7.24% ethane and other $C_2$ components, 3.2% propane and other $C_3$ components, 0.34% isobutane, 1.12% normal butane, 0.19% iso-pentane, 0.24% normal pentane, 0.12% hexanes plus, with the balance made up of nitrogen and carbon dioxide. Sulfur containing gases are also sometimes present.

The cryogenic expansion process is now the preferred process for the separation of ethane and heavier hydrocarbons from natural gas streams because it provides maximum simplicity, ease of start-up, operating flexibility, good efficiency and good reliability. The cryogenic expansion process is also preferred for the separation of propane and heavier hydrocarbons from natural gas streams while rejecting the ethane into the residue gas stream with the methane. In fact, it is quite common to see the same basic processing scheme used for either ethane recovery or propane recovery, with only the heat exchanger arrangement modified to accommodate the different operating temperatures within the process. U.S. Pat. Nos. 4,278,457, 4,251,249 and 4,617,039 describe relevant processes.

In recent years the fluctuations in both the demand for ethane as a liquid product and in the price of natural gas have created periods in which ethane was more valuable as a constituent of the residue gas streams from gas processing plants. This has resulted in the desire for gas processing facilities to maximize propane and heavier hydrocarbon recovery while, at the same time, maximizing the rejection of ethane into the residue gas stream. Although many variations of the turbo-expander process have been used in the past for propane recovery, they have usually been limited to propane recoveries in the mid-eighty percent to lower ninety percent range without excessive horsepower requirements for residue compression and/or external refrigeration. Although propane recoveries can be improved somewhat by allowing some of the ethane to be recovered in the liquid product, usually a significant percentage of the inlet ethane must leave in the liquid product to provide a small improvement in propane recovery. It is, therefore, desirable to have a process which is capable of recovering propane and heavier components from a gas stream in which only a minor amount of propane is lost to the residue gas while at the same time rejecting essentially all of the ethane.

In a typical cryogenic expansion process, the feed gas under pressure is cooled in one or more heat exchangers by cold streams from other parts of the process and/or by use of external sources of refrigeration such as a propane compression-refrigeration system. The cooled feed is then expanded to a lower pressure and fed to a distillation column which separates the desired product (as a bottom liquid product) from the residue gas which is discharged as column overhead vapor. It is the expansion of the cooled feed which provides the cryogenic temperatures required to achieve the desired product recoveries.

As the feed gas is cooled, liquids may be condensed, depending on the richness of the gas, and these liquids are typically collected in one or more separators. The liquids are then flashed to a lower pressure which results in further cooling and partial vaporization. The expanded liquid stream(s) may then flow directly to the distillation column (deethanizer) or may be used to provide cooling to the feed gas before flowing to the column.

If the feed gas is not totally condensed (usually it is not), the vapor remaining after cooling can be split into two or more parts. One portion of the vapor is passed through a work expansion machine or engine, or expansion valve, to a lower pressure. This results in further cooling of the gas and the formation of additional liquids. This stream then flows to the distillation column at a mid-column feed position.

The other portion of the vapor is cooled to substantial condensation by heat exchange with other process streams, e.g. the cold distillation column overhead. This substantially condensed stream is then expanded through an appropriate expansion device, typically an expansion valve. This results in cooling and partial vaporization of the stream. This stream, usually at a temperature below −120° F., is supplied as a top feed to the column. The vapor portion of this top feed is typically combined with the vapor rising from the column to form the residue gas stream. Alternatively, the cooled and expanded stream may be supplied to a separator to provide vapor and liquid streams. The vapor is combined with the column overhead and the liquid is supplied to the column as a top column feed.

In the ideal operation of such a separation process, the residue gas leaving the process will contain substantially all of the methane and $C_2$ components found in the feed gas and essentially none of the $C_3$ components and heavier hydrocarbon components. The bottom product leaving the deethanizer will contain substantially all of the $C_3$ components and heavier components and essentially no $C_2$ components and lighter components.

In practice, however, this situation is not obtained due to the fact that the deethanizer is operated basically as a stripping column. The residue gas product consists of the vapors leaving the top fractionation stage of the distillation column together with the vapors not subjected to any rectification. Substantial losses of propane occur because the top liquid feed contains considerable quantities of propane and the heavier components, resulting in corresponding (equilibrium) quantities of propane and heavier components in the vapor leaving the top fractionation stage of the deethanizer. The loss of these desirable components could be significantly reduced if the vapors could be brought into contact with a liquid (reflux), containing very little of the propane and heavier components, which is capable of absorbing propane and heavier hydrocarbons from the vapors.

The present invention provides the means for accomplishing this objective and, therefore, significantly improving the recovery of propane.

In accordance with the present invention, it has been found that $C_3$ recoveries in excess of 99 percent can be maintained while providing essentially complete rejection of $C_2$ components to the residue gas stream. In addition, the present invention makes posiible essentially 100 percent propane recovery at reduced energy requirements, depending on the amount of ethane which is allowed to leave the process in the liquid product. Although applicable at lower pressures and warmer temperatures, the present invention is particularly advantageous when processing feed gases in the range of 600 to 1000 psia or higher under conditions requiring column overhead temperatures of −85° F. or colder.

For a better understanding of the present invention, reference is made to the following examples and drawings. Referring to the drawings:

FIG. 1 is a flow diagram of a cryogenic expansion natural gas processing plant of the prior art according to U.S. Pat. No. 4,278,457.

FIG. 2 is a flow diagram of a cryogenic expansion natural gas processing plant of another prior art design according to U.S. Pat. No. 4,251,249.

FIG. 3 is a flow diagram of a cryogenic expansion natural gas processing plant of another prior art process according to U.S. Pat. No. 4,617,039.

In the following explanation of these figures, tables are provided summarizing flow rates calculated for representative process conditions. In the tables appearing herein, the values for flow rates (in pound moles per hour) have been rounded to the nearest whole number, for convenience. The total stream rates shown in the tables include all non-hydrocarbon components and hence are typically larger than the sum of the stream flow rates for the hydrocarbon components. Temperatures indicated are approximate values, rounded to the nearest degree. It should also be noted that the process design calculations performed for the purpose of comparing the processes depicted in the above figures are based on the assumption of no heat leak from (or to) the surroundings to (or from) the process. The quality of commercially available insulating materials used for minimizing heat loss/gain makes this a very reasonable assumption and one that is typically made by those skilled in the art.

DESCRIPTION OF PRIOR ART

Figure 1:
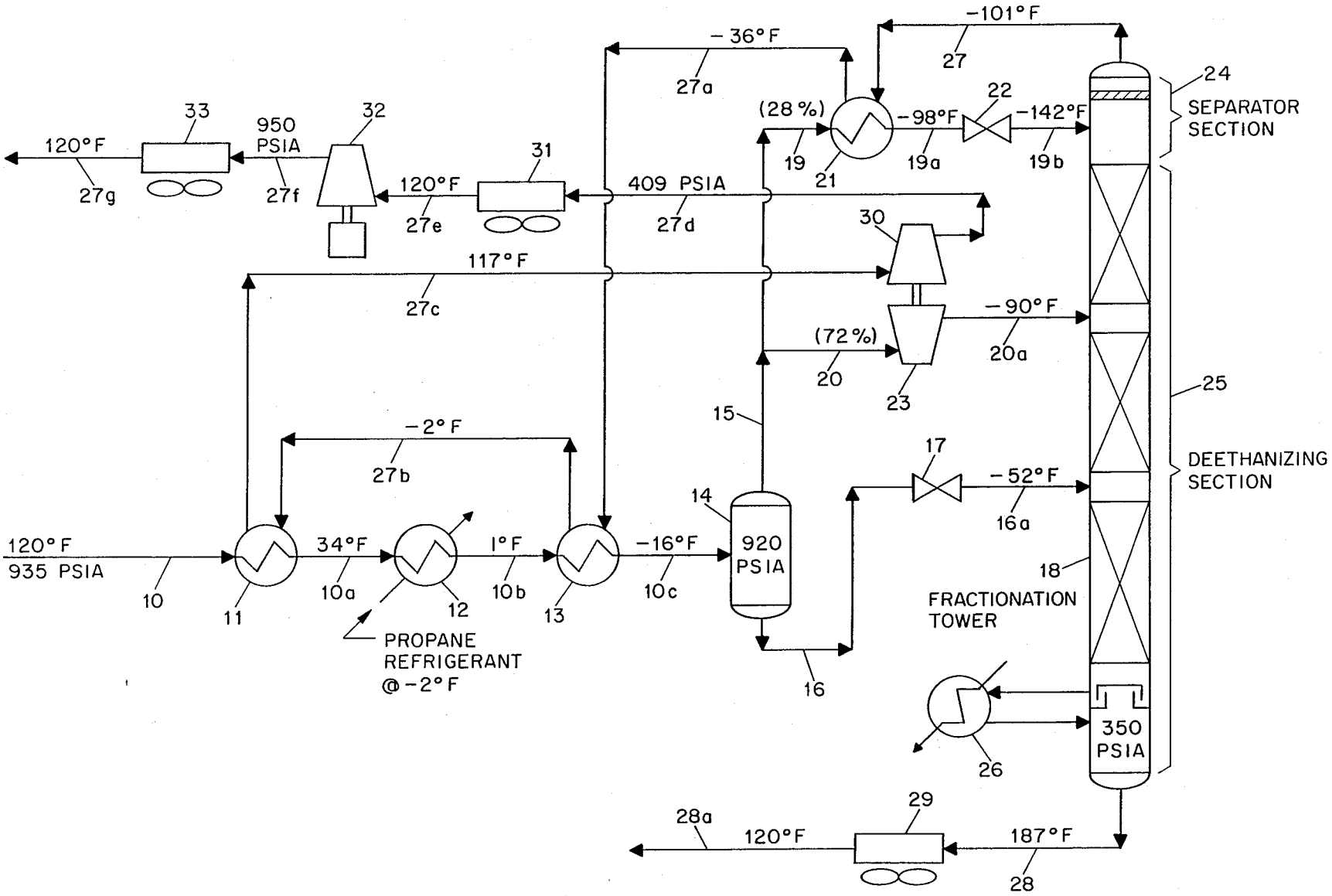
FIG. 1 (PRIOR ART)

Referring now to FIG. 1, in a simulation of the process according to U.S. Pat. No. 4,278,457, inlet gas enters the process at 120° F. and 935 psia as stream 10. If the inlet gas contains a concentration of sulfur compounds which would cause the product streams to not meet specifications, the sulfur compounds are removed by appropriate pretreatment of the feed (not illustrated). In addition, the feed stream is usually dehydrated to prevent hydrate (ice) formation under cryogenic conditions. Solid desiccant has typically been used for this purpose. The feed stream is cooled in heat exchanger 11 by cool residue gas stream **27*b*. From heat exchanger 11, the partially cooled feed stream 10*a* at 34° F. enters a second heat exchanger 12 where it is cooled by heat exchange with an external propane refrigeration stream. The further cooled feed stream 10*b* exits heat exchanger 12 at 1° F. and is cooled to −16° F. (stream 10*c*) by residue gas (stream 27*a*) in heat exchanger 13. The partially condensed stream then flows to a vapor-liquid separator 14 at a pressure of 920 psia. Liquid from the separator, stream 16, is expanded in expansion valve 17 to the operating pressure (approximately 350 psia) of the distillation column, which in this instance is the deethanizing section 25 of fractionation tower 18. The flash expansion of stream 16 produces a cold expanded stream 16*a* at a temperature of −52° F., which is supplied to the distillation column as a lower mid-column feed. Depending on the quantity of liquid condensed and other process considerations, the expanded stream 16*a*** could be used to provide a portion of the inlet gas cooling in an additional exchanger before flowinq to the deethanizer.

The vapor stream 15 from separator 14 is divided into two branches 19 and 20. Following branch 19, which contains approximately 28 percent of vapor stream 15, the gas is cooled in heat exchanger 21 to −98° F. (stream **19*a*) at which temperature it is substantially condensed. The stream is then expanded in expansion valve 22. (While an expansion valve is usually preferred, an expansion machine could be substituted.) Upon expansion, the stream flashes to the operating pressure of the deethanizer (350 psia). At this pressure, the feed stream 19*b*** is at a temperature of −142° F. and is supplied to the deethanizer as the top column feed.

Approximately 72 percent of the separator vapor, branch 20, is expanded in an expansion engine 23 to the deethanizer operating pressure of 350 psia. The expanded stream **20*a*** reaches a temperature of −90° F. and is supplied to the deethanizer at a mid-column position. Typical commercially available expansion machines (turbo-expanders) are capable of recovering on the order of 80–85% of the work theoretically available in an ideal isentropic expansion.

The deethanizer in tower 18 is a conventional distillation column containing a plurality of vertically spaced trays, one or more packed beds, or some combination of trays and packing. As is often the case in natural gas processing plants, the tower consists of two sections. The upper section 24 is a separator wherein the partially vaporized top feed is divided into its respective liquid and vapor portions and wherein the vapor rising from the deethanizing or distillation section 25 is combined with the vapor portion of the top feed to form the cold residue gas stream 27 which exits the top of the tower. The lower, deethanizing section 25 contains trays and/or packing and provides the necessary contact between the liquids falling downward and the vapors rising upward. The deethanizing section also includes a reboiler 26 which heats and vaporizes a portion of the liquid at the bottom of the column to provide the stripping vapors which flow up the column to strip the product of methane and $C_2$ components. A typical specification for the bottom liquid product is to have an ethane to propane ratio of 0.03:1 on a molar basis. The liquid product stream 28 exits the bottom of tower 18 at 187° F. and is cooled to 120° F. (stream 28*a*) in exchanger 29 before flowing to storage. The residue gas stream 27 exits the top of the tower at −101° F. and enters heat exchanger 21 where it is warmed to −36° F. as it provides the cooling and substantial condensation of stream 19. The residue gas (stream 27*a*) then flows to heat exchanger 13 where it is warmed to −2° F. (stream 27*b*) followed by heat exchanger 11 where it is warmed to 117° F. as it provides cooling of the inlet gas stream 10. The warmed residue gas stream 27*c* is then partly re-compressed in the compressor 30 driven by the expansion turbine 23. The partly compressed stream 27*d* is then cooled to 120° F. in exchanger 31 (stream 27*e*) and then compressed to a pressure of 950 psia (stream 27*f*) in compressor 32 driven by an external power source. The stream is then cooled in exchanger 33 and exits the process at 120° F. as stream 27*g*.

A summary of stream flow rates and energy consumption for the process of FIG. 1 is set forth in the following table:

TABLE I (FIG. 1)
Stream Flow Summary - Lb. Moles/Hr:

| Stream | Methane | Ethane | Propane | Butanes+ | Total |
|---|---|---|---|---|---|
| 10 | 5297 | 441 | 194 | 122 | 6094 |
| 15 | 5139 | 389 | 140 | 52 | 5760 |
| 16 | 158 | 52 | 54 | 70 | 334 |
| 19 | 1441 | 109 | 39 | 15 | 1615 |
| 20 | 3698 | 280 | 101 | 37 | 4145 |
| 27 | 5297 | 436 | 11 | 0 | 5784 |
| 28 | 0 | 5 | 183 | 122 | 310 |
| | Recoveries* | | | | |
| | Propane | | | 94.28% | |
| | Butanes | | | 99.31% | |
| | Horsepower | | | | |
| | Residue Compression | | | 3115 | |
| | Refrigeration Compression | | | 568 | |
| | Total | | | 3683 | |

*(Based on un-rounded flow rates)

Figure 2:
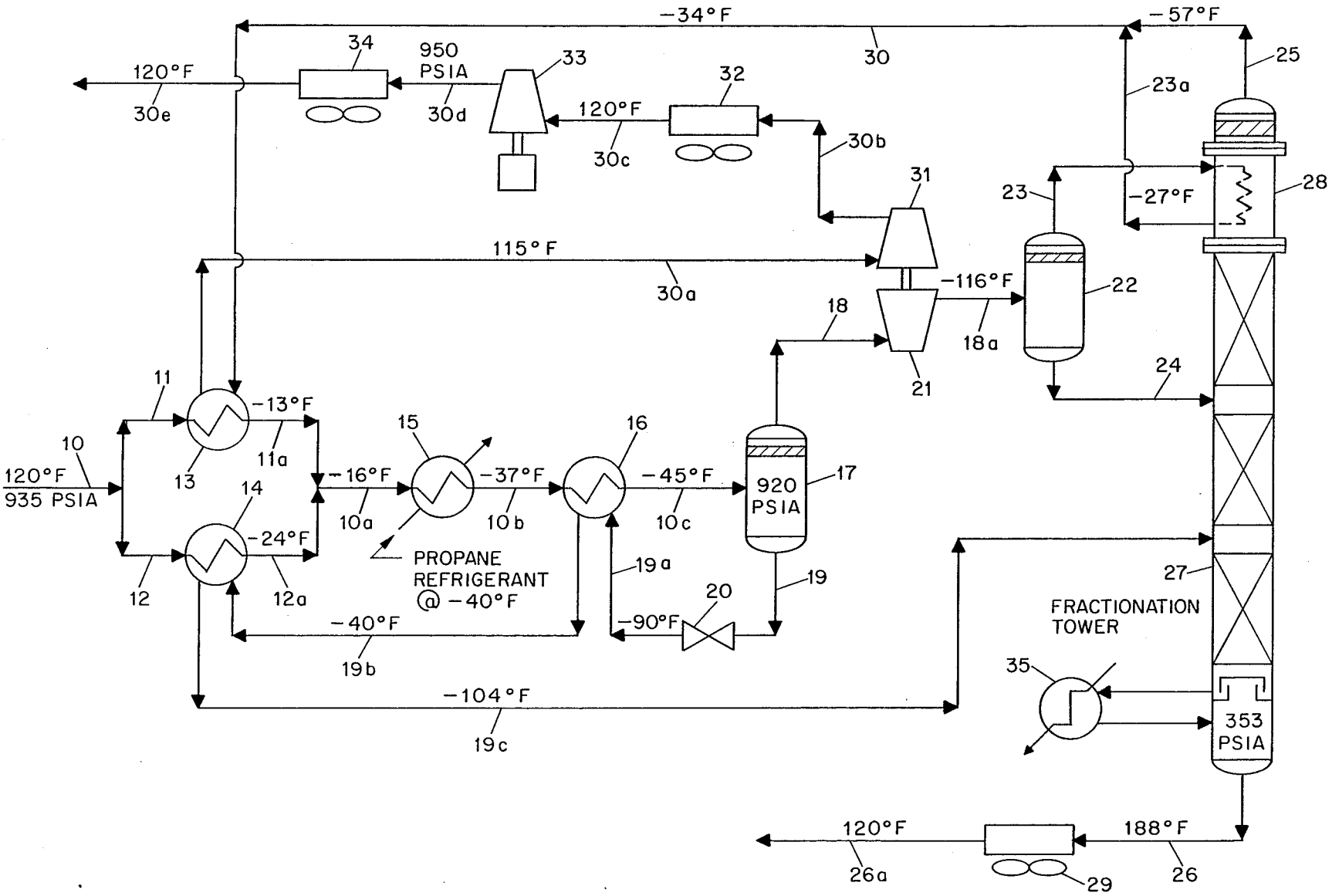
FIG. 2 (PRIOR ART)

FIG. 2 represents an alternative prior art process in accordance with U.S. Pat. No. 4,251,249. The process of FIG. 2 is based on the same feed gas composition and conditions as described above for FIG. 1. In the simulation of this process, the inlet feed gas 10 is divided into two portions, 11 and 12 which are partially cooled in heat exchangers 13 and 14, respectively. The two portions recombine as stream 10*a* to form a partially cooled feed gas stream at −16° F. The partially cooled feed is then further cooled by means of external propane refrigeration in heat exchanger 15 to −37° F. (stream 10*b*). The further cooled stream then undergoes final cooling in heat exchanger 16 to a temperature of −45° F. (stream 10*c*) and is then supplied to a vapor-liquid separator 17 at a pressure of about 920 psia. Liquid stream 19 from separator 17 is flash expanded in expansion valve 20 to a pressure just above the operating pressure of the deethanizer in fractionation tower 27. In the process of FIG. 2, the deethanizer operates at about 353 psia. The flash expansion of stream 19 produces a cold, partially vaporized expanded stream 19*a* at a temperature of −90° F. This stream then flows to exchanger 16 where it is warmed and further vaporized (stream 19*b*) as it provides final cooling of feed gas stream 10*b*. From exchanger 16 the further vaporized stream 19*b* flows to exchanger 14 where it is heated to 104° F. as it provides cooling of stream 12. From exchanger 14 the heated stream 19*c* flows to the deethanizer section of the tower 27 at a lower mid-column feed position.

The vapor stream 18 from separator 17 is expanded in expansion machine 21 to the deethanizer operating pressure. The expanded stream 18*a* reaches a temperature of −116° F. upon expansion and enters an expander outlet separator 22. Liquid stream 24 from separator 22 flows to the distillation section of the fractionation tower at an upper mid-column feed position. Vapor stream 23 from expander separator 22 flows to reflux condenser 28 located internally in the upper part of the fractionation tower. The cold expander outlet vapor stream 23 provides cooling and partial condensation of the vapor flowing upward from the top-most fractionation stage of the distillation column. The liquids resulting from this partial condensation fall downward as reflux to the deethanizer. As a result of providing this cooling and partial condensation, the expander outlet vapor stream is warmed to a temperature of −27° F. (stream 23*a*).

The deethanizer overhead vapor stream 25 exits from the top of the column at a temperature of −57° F. and combines with the warmed expander outlet separator vapor stream 23*a* to form the cold residue gas stream 30 at a temperature of −34° F. The liquid product stream 26 exits the bottom of tower 27 at a temperature of 188° F. and is cooled to 120° F. in exchanger 29 before leaving the process. The deethanizer reboiler 35 heats and partially vaporizes a portion of the liquid flowing down the column to help strip the product of ethane.

The cold residue gas stream 30 at −34° F. enters heat exchanger 13 where it is warmed to 115° F. as it provides cooling of inlet gas stream 11. The warmed residue gas stream 30*a* is then partly compressed in the compressor 31 driven by the expansion machine 21. The partly re-compressed stream 30*b* is then cooled to −120° F. in exchanger 32 (stream 30*c*) and then compressed to 950 psia (stream 30*d*) in compressor 33 driven by an external power source. The compressed stream 30*d* is then cooled to 120° F. in exchanger 34 and exits the process as stream 30*e*.

A summary of stream flow rates and energy consumption for the process of FIG. 2 is set forth in the following table:

TABLE II (FIG. 2)
Stream Flow Summary - Lb. Moles/hr:

| Stream | Methane | Ethane | Propane | Butanes+ | Total |
|---|---|---|---|---|---|
| 10 | 5297 | 441 | 194 | 122 | 6094 |
| 18 | 4788 | 308 | 89 | 25 | 5248 |
| 19 | 509 | 133 | 105 | 97 | 846 |
| 23 | 4484 | 154 | 11 | 0 | 4686 |
| 24 | 304 | 154 | 78 | 25 | 562 |
| 26 | 0 | 5 | 183 | 122 | 310 |
| 30 | 5297 | 436 | 11 | 0 | 5784 |
| | Recoveries* | | | | |
| | Propane | | | 94.36% | |
| | Butanes | | | 100.00% | |
| | Horsepower | | | | |
| | Residue Compression | | | 2975 | |
| | Refrigeration Compression | | | 706 | |
| | | | | 3681 | |

*(Based on un-rounded flow rates)

Figure 3:
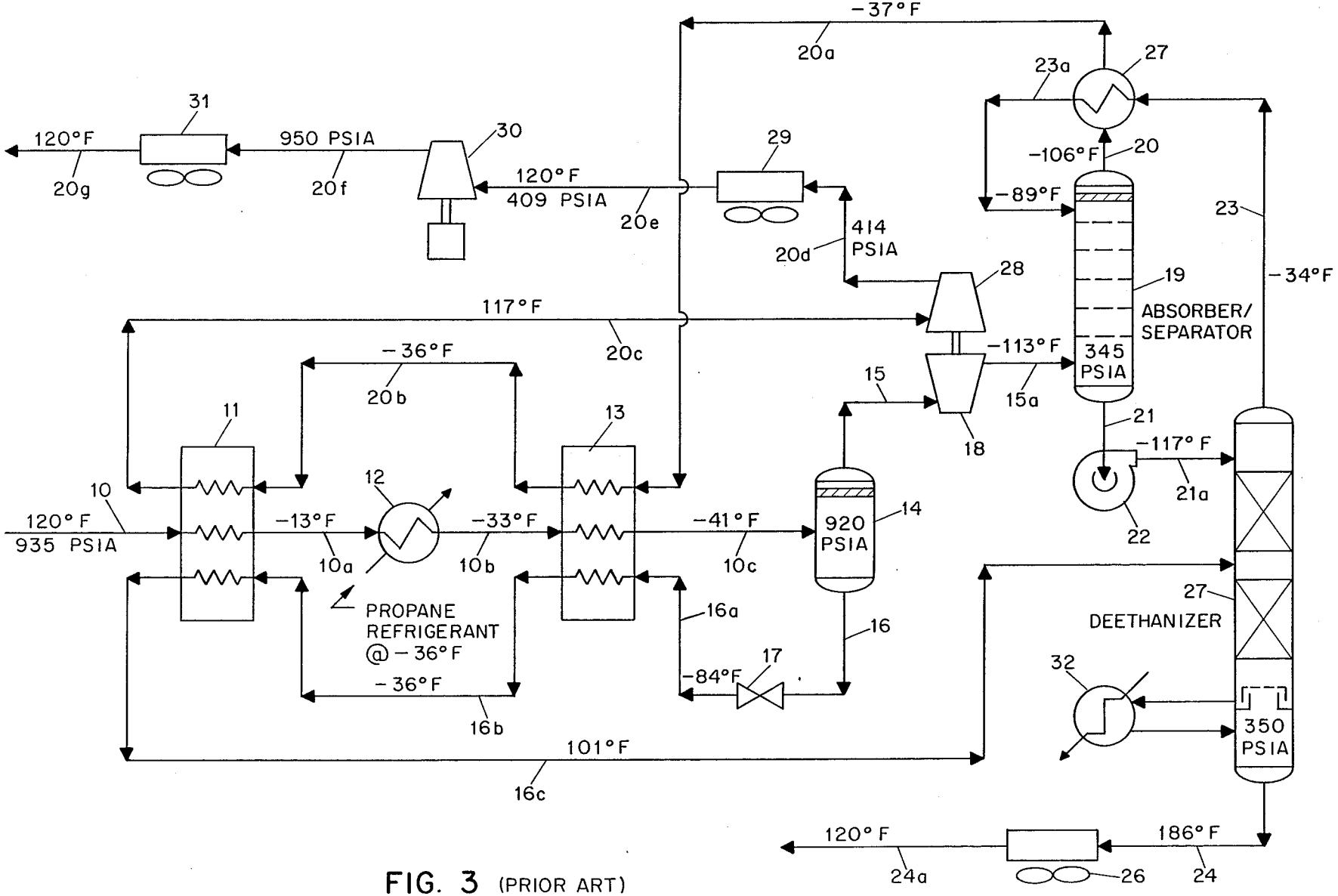
FIG. 3 (PRIOR ART)

FIG. 3 represents an alternative prior art process in accordance with U.S. Pat. No. 4,617,039. The process of FIG. 3 is based on the same feed gas composition and conditions as described above for FIGS. 1 and 2. In the simulation of this process, the inlet feed gas 10 is partially cooled in exchanger 11 to a temperature of −13° F. (stream 10*a*). The partially cooled stream is then further cooled by means of external propane refrigeration in heat exchanger 12 to −33° F. (stream 10*b*). The further cooled stream then undergoes final cooling in heat exchanger 13 to a temperature of −41° F. (stream 10*c*) and is then supplied to a vapor-liquid separator 14 at a pressure of about 920 psia. Liquid stream 16 from the separator 14 is flash expanded in expansion valve 17 to a pressure about 10 psi above the operating pressure of deethanizer 27. In the process of FIG. 3, the deethanizer operates at about 350 psia. The flash expansion of stream 16 produces a cold, partially vaporized expanded stream 16*a* at a temperature of −84° F. This stream then flows to exchanger 13 where it is warmed and further vaporized as it provides a portion of the final cooling of feed gas stream 10*b*. The further vaporized stream 16*b* then flows to exchanger 11 where it is heated to 101° F. as it provides cooling of stream 10. From exchanger 11 the heated stream 16*c* flows to deethanizer 27 at a mid-column feed position.

The vapor stream 15 from separator 14 is expanded in expansion machine 18 to a pressure about 5 psi below the operating pressure of the deethanizer. The expanded stream 15*a* reaches a temperature of −113° F., at which temperature it is partially condensed, and then flows to the lower feed position of absorber/separator 19. The liquid portion of the expanded stream commingles with liquids falling downward from the upper section of the absorber/separator and the combined liquid stream 21 exits the bottom of absorber/separator 19 This stream is then supplied as top feed (stream 21*a*) to deethanizer 27 at a temperature of −117° F. via pump 22. The vapor portion of the expanded stream flows upward through the fractionation section of absorber/separator 19.

The overhead vapor from absorber/separator 19 (stream 20) is the cold residue gas stream. This cold stream passes in heat exchange relation with the overhead vapor stream from the deethanizer (stream 23) in heat exchanger 27. The deethanizer overhead vapor stream 23 exits the top of the column at a temperature of −34° F. and a pressure of 350 psia. The cold residue gas stream 20 is warmed to approximately −37° F. (stream 20*a* as it provides cooling and partial condensation of the deethanizer overhead. The partially condensed deethanizer overhead stream 23*a* then flows as top feed to absorber/separator 19 at a temperature of −89° F. The liquid portion of this stream 23*a* flows downward onto the top fractionation stage of the absorber/separator while the vapor portion combines with the vapor rising upward from the fractionation section and the combined stream exits the top of the absorber/separator as cold residue gas (stream 20).

The liquid product stream 24 exits the bottom of the deethanizer at a temperature of 186° F. and is cooled to 120° F. (stream 24*a*) in exchanger 26 before leaving the process. The deethanizer reboiler 32 heats and partially vaporizes a portion of the liquid flowing down the column to strip the product of ethane.

The residue exits exchanger 27 at a temperature of −37° F. and flows through exchangers 13 and 11 where it is warmed to a temperature of 117° F. The warmed residue gas stream 20*c* is then partly compressed in compressor 28 driven by the expansion machine 18. The partly re-compressed stream 20*d*, now at a pressure of about 414 psia, is cooled to 120° F. (stream 20*e*) in exchanger 29 and then compressed to 950 psia (stream 20*f*) in compressor 30 driven by an external power source. The compressed stream 20*f* is then cooled to 120° F. in exchanger 31 and exits the process as stream 20*g*.

A summary of stream flow rates and energy consumption for the process for FIG. 3 is set forth in the following table:

TABLE III (FIG. 3)

| Stream | Methane | Ethane | Propane | Butanes+ | Total |
|---|---|---|---|---|---|
| | Stream Flow Summary - Lb. Moles/hr: | | | | |
| 10 | 5297 | 441 | 194 | 122 | 6094 |
| 15 | 4878 | 325 | 97 | 29 | 5367 |
| 16 | 419 | 116 | 97 | 93 | 727 |
| 20 | 5297 | 435 | 3 | 0 | 5775 |
| 21 | 745 | 470 | 114 | 30 | 1362 |
| 23 | 1164 | 580 | 20 | 1 | 1770 |
| 24 | 0 | 6 | 191 | 122 | 319 |
| | Recoveries* | | | | |
| | Propane | | | 98.41% | |
| | Butanes | | | 99.96% | |
| | Horsepower | | | | |
| | Residue Compression | | | 3066 | |
| | Refrigeration Compression | | | 612 | |
| | Total | | | 3678 | |

*(Based on un-rounded flow rates)

DESCRIPTION OF THE INVENTION

Figure 4:
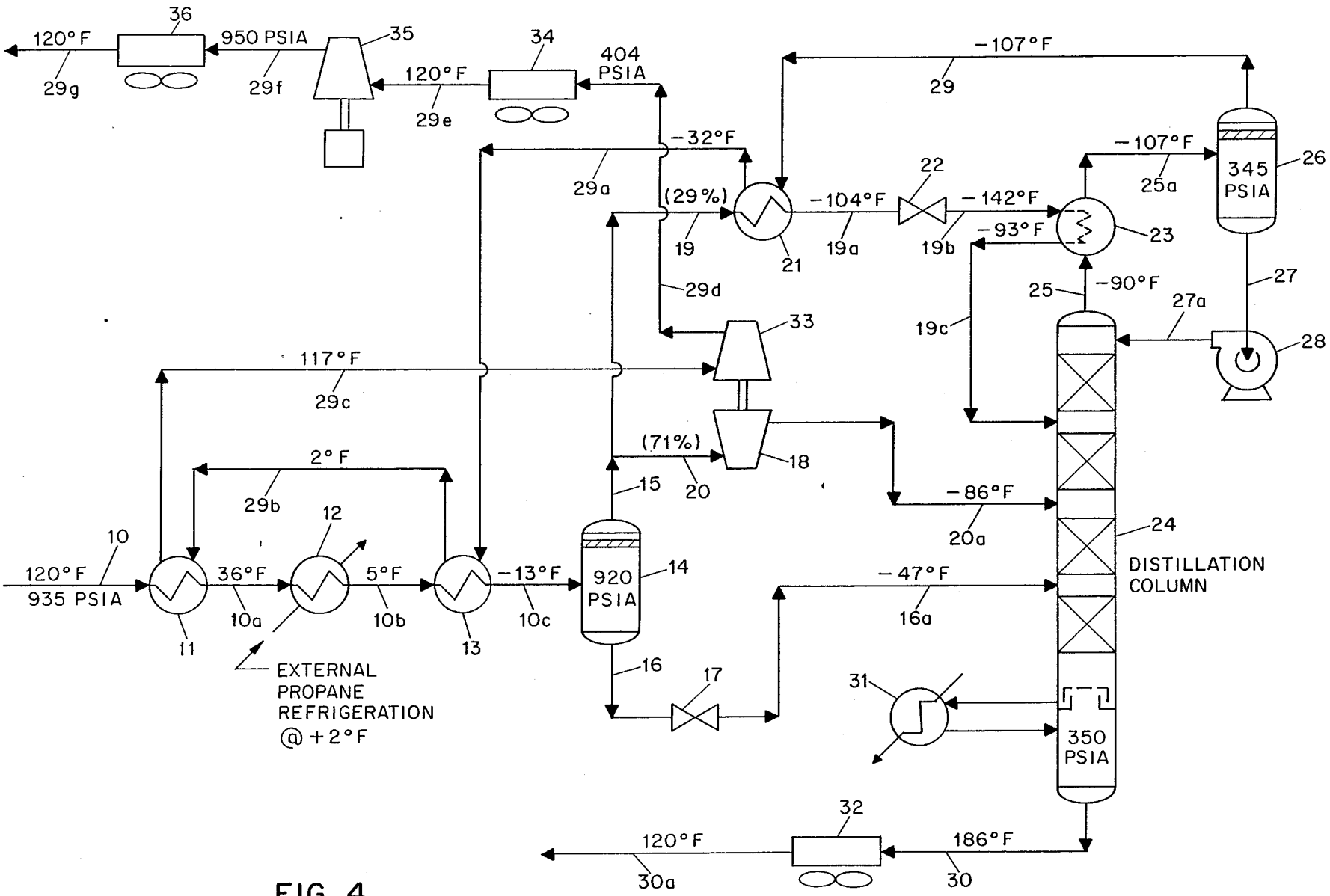
FIG. 4 is a flow diagram of a natural gas processing plant in accordance with the present invention.

FIG. 4 illustrates a flow diagram of a process in accordance with the present invention. The feed gas composition and conditions considered in the process of FIG. 4 are the same as those in FIGS. 1 through 3. Accordingly, the process for FIG. 4 and flow conditions can be compared with the processes of FIGS. 1 through 3 to illustrate the advantages of the present invention.

In the simulation of the process of FIG. 4, inlet gas enters the process at 120° F. and 935 psia as stream 10. The feed is cooled in heat exchanger 11 by cool residue gas stream 29*b*. From heat exchanger 11, the partially cooled feed stream 10*a* at 36° F. is further cooled to −5° F. in heat exchanger 12 by external propane refrigeration at −2° F. This further cooled stream 10*b* is then cooled to −13° F. (stream 10*c*) by residue gas stream 29*a* in heat exchanger 13. The partially condensed stream 10*c* then enters vapor-liquid separator 14 at a pressure of 920 psia. Liquid stream 16 from separator 14 is expanded in expansion valve 17 to the operating pressure of the distillation column 24. In the process of FIG. 4 the column operates at 350 psia. The flash expansion of condensed stream 16 produces a cold expanded stream 16*a* at a temperature of −47° F. which is supplied to the column as a partially condensed feed at a lower mid-column feed position.

The vapor stream 15 from seprrator 14 is divided into gaseous first and second streams, 19 and 20. Following branch 19, approximately 29 percent of stream 15 is cooled in heat exchanger 21 to −104° F. (stream 19*a*) at which temperature the stream is substantially condensed. The substantially condensed stream 19*a* is then expanded in expansion valve 22 and supplied to heat exchanger 23. The flash expansion of stream 19*a* to a lower pressure results in a cold flash expanded stream 19*b* at a temperature of −142° F. This stream is warmed and partially vaporized in heat exchanger 23 as it provides cooling and partial condensation of the distillation stream 25 rising from the fractionation stages of column 24. The warmed stream 19*c* at a temperature of −93° F. is then supplied to the column at an upper mid-column feed position. Stream 25 is cooled to a temperature of −107° F. (stream 25a) by heat exchange with stream 19b. This partially condensed stream 25a is supplied to separator 26 operating at about 345 psia. Liquid stream 27 from separator 26 is returned to the column 24 as reflux stream 27a at a top column feed position above the upper mid-column feed position by means of a reflux pump 28. The vapor stream 29 from separator 26 is the cold volatile residue gas stream.

Figure 9:
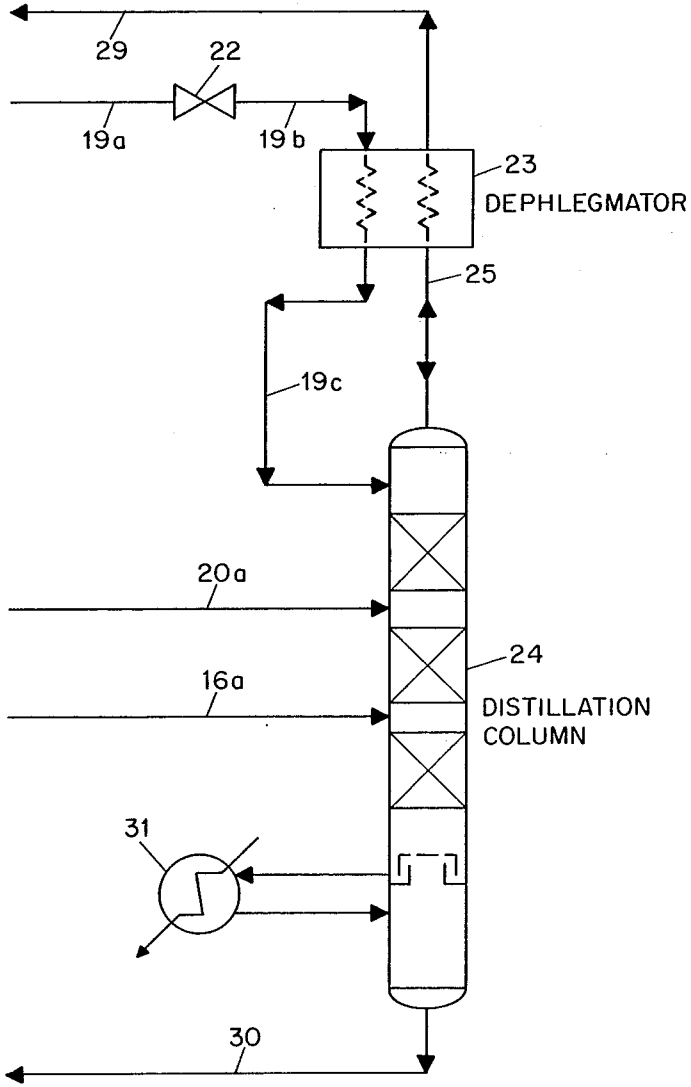
FIGS. 8 and 9 are diagrams of alternate fractionating systems which may be employed in the process of the present invention.
Figure 8:
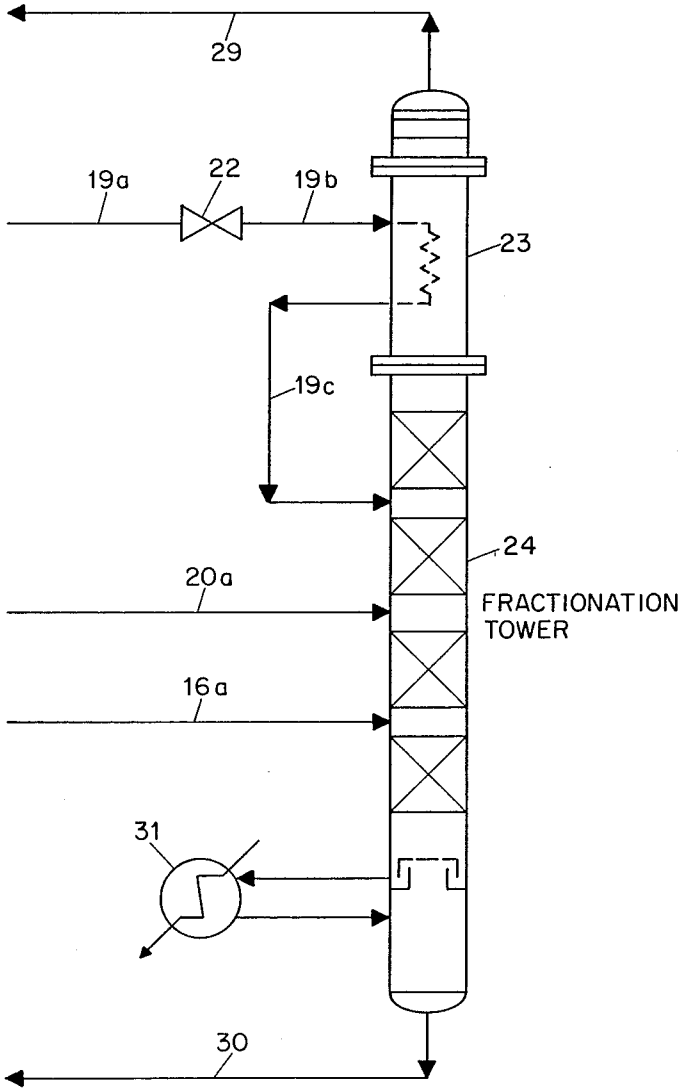

When the distillation column forms the lower portion of a fractionation tower, heat exchanger 23 may be located inside the tower above column 24 as shown in FIG. 8. This eliminates the need for separator 26 and pump 28 because the distillation stream is then both cooled and separated in the tower above the fractionation stages of the column. Alternatively and as depicted in FIG. 9, use of a dephlegmator in place of heat exchanger 23 eliminates the separator and pump and also provides concurrent fractionation stages to replace those in the upper section of the deethanizer column. If the dephlegmator is positioned in a plant at grade level, it is connected to a vapor/liquid separator and liquid collected in the separator is pumped to the top of the distillation column. The decision as to whether to include the heat exchanger inside the column or to use the dephlegmator usually depends on plant size and heat exchanger surface area requirements.

Returning to gaseous second stream 20, the remaining portion of vapor stream 15 is expanded in work expansion machine 18 to the lower, operating pressure of the column and is thereafter supplied to the column 24 at a mid-column feed position. Expansion of stream 20 results in a cold expanded stream 20a at a temperature of −86° F.

The liquid product stream 30 exits the bottom of column 24 at a temperature of 186° F. and is cooled to −120° F. (stream 30a) by exchanger 32 before flowing to storage. The cold residue gas stream 29 flows to heat exchanger 21 where it is partially warmed to −32° F. (stream 29a) as it provides cooling and substantial condensation of stream 19. The partially warmed stream 29a then flows to heat exchanger 13 where it is further warmed to 2° F. as it provides cooling of inlet gas stream 10b. The further warmed residue gas stream 29b is then warmed to 117° F. in heat exchanger 11 as it provides cooling of inlet gas stream 10. The warmed residue gas stream 29c, now at about 330 psia, is partly re-compressed in compressor 33 driven by the expansion machine 18. The partly re-compressed residue gas stream 29d at about 404 psia is cooled to 120° F. (stream 29e) in exchanger 34, compressed to 950 psia (stream 29f) in compressor 35 driven by an external power source, cooled to 120° F. (stream 29g) in exchanger 36 and then exits the process.

A summary of stream flow rates and energy consumption for the process of FIG. 4 is set forth in the following table:

TABLE IV (FIG. 4)
Stream Flow Summary - Lb. Moles/Hr:

| Stream | Methane | Ethane | Propane | Butanes+ | Total |
|---|---|---|---|---|---|
| 10 | 5297 | 441 | 194 | 122 | 6094 |
| 15 | 5161 | 396 | 146 | 56 | 5799 |
| 16 | 136 | 45 | 48 | 66 | 295 |
| 19 | 1497 | 115 | 42 | 16 | 1682 |
| 20 | 3664 | 281 | 104 | 40 | 4117 |
| 29 | 5297 | 435 | 1 | 0 | 5773 |
| 30 | 0 | 6 | 193 | 122 | 321 |
| Recoveries* | | | | | |
| Propane | | | | 99.68% | |
| Butanes | | | | 100.00% | |
| Horsepower | | | | | |
| Residue Compression | | | | 3164 | |
| Refrigeration Compression | | | | 514 | |
| | | | | 3678 | |

*(Bsed on un-rounded flow rates)

The improvement of the present invention can be seen by comparing the propane recovery levels in Tables I through IV. The present invention offers more than 5 percentage points improvement in propane recovery for the same horsepower (utility) consumption as the prior art processes of FIGS. 1 and 2 and more than 1.25 percentage points improvement compared to the FIG. 3 prior art process. A one percent increase in propane recovery can mean substantial economic advantages for a gas processor during the life of a plant.

As an alternate to the higher $C_3$ component recovery (at constant utility consumption) disclosed for FIG. 4 above, the operating conditions of the FIG. 4 process can be adjusted to obtain a propane recovery level equal to the FIG. 1 or FIG. 2 process at significantly reduced horsepower requirements. As an example, the operating pressure of the deethanizer in FIG. 4 can be increased to about 385 psia. This results in somewhat warmer temperatures in and around the deethanizer. The vapor liquid separator 14 operates at a temperature of −13° F. with 29 percent of the separator vapor 15 flowing in stream 19 to heat exchanger 21. The substantially condensed stream 19a exits heat exchanger 21 at −96° F. and is flash expanded via expansion valve 22 to 390 psia. The temperature of flash expanded stream 19b in this case is −136° F. This stream is then heated to −81° F. in heat exchanger 23 as it provides cooling and partial condensation of the distillation stream 25 before being supplied to the deethanizer.

Because of the higher operating pressure of the distillation column, the expansion engine 18 outlet stream 20a and expansion valve 17 outlet stream 16a are both warmer. In this example the temperatures of these streams are −81° F. and −44° F., respectively.

The cold residue gas stream 29 exits the vaporliquid separator 26 at a temperature of −99° F. and a pressure of 380 psia. This stream is heated in exchangers 21, 13 and 11 before being compressed as discussed previously. Because the pressure of the residue gas leaving the column is higher, less residue compression horsepower is required. The liquid product stream 30 exits the bottom of the column at −197° F. and is cooled to 120° F. (stream 30a) in exchanger 32.

A summary of stream flow rates and energy consumption for the alternate processing conditions of FIG. 4 is set forth in the following table:

TABLE V (Alternate FIG. 4 Operating Conditions)
Stream Flow Summary - Lb. Moles/Hr:

| Stream | Methane | Ethane | Propane | Butanes+ | Total |
|---|---|---|---|---|---|
| 10 | 5297 | 441 | 194 | 122 | 6094 |
| 15 | 5161 | 396 | 146 | 56 | 5798 |
| 16 | 136 | 45 | 48 | 66 | 296 |
| 19 | 1497 | 115 | 42 | 16 | 1681 |
| 20 | 3664 | 281 | 104 | 40 | 4117 |
| 29 | 5297 | 436 | 11 | 0 | 5783 |

TABLE V-continued

| (Alternate FIG. 4 Operating Conditions) Stream Flow Summary - Lb. Moles/Hr: | | | | | |
|---|---|---|---|---|---|
| Stream | Methane | Ethane | Propane | Butanes+ | Total |
| 30 | 0 | 5 | 183 | 122 | 311 |
| Recoveries* | | | | | |
| Propane | | | | 94.29% | |
| Butanes | | | | 100.00% | |
| Horsepower | | | | | |
| Residue Compression | | | | 2826 | |
| Refrigeration Compression | | | | 500 | |
| | | | | 3326 | |

*(Based on un-rounded flow rates)

On a constant recovery basis, therefore, the present invention provides almost a 10 percent reduction in energy (horsepower) consumption compared to the prior art processes of FIGS. 1 and 2.

Figure 5:
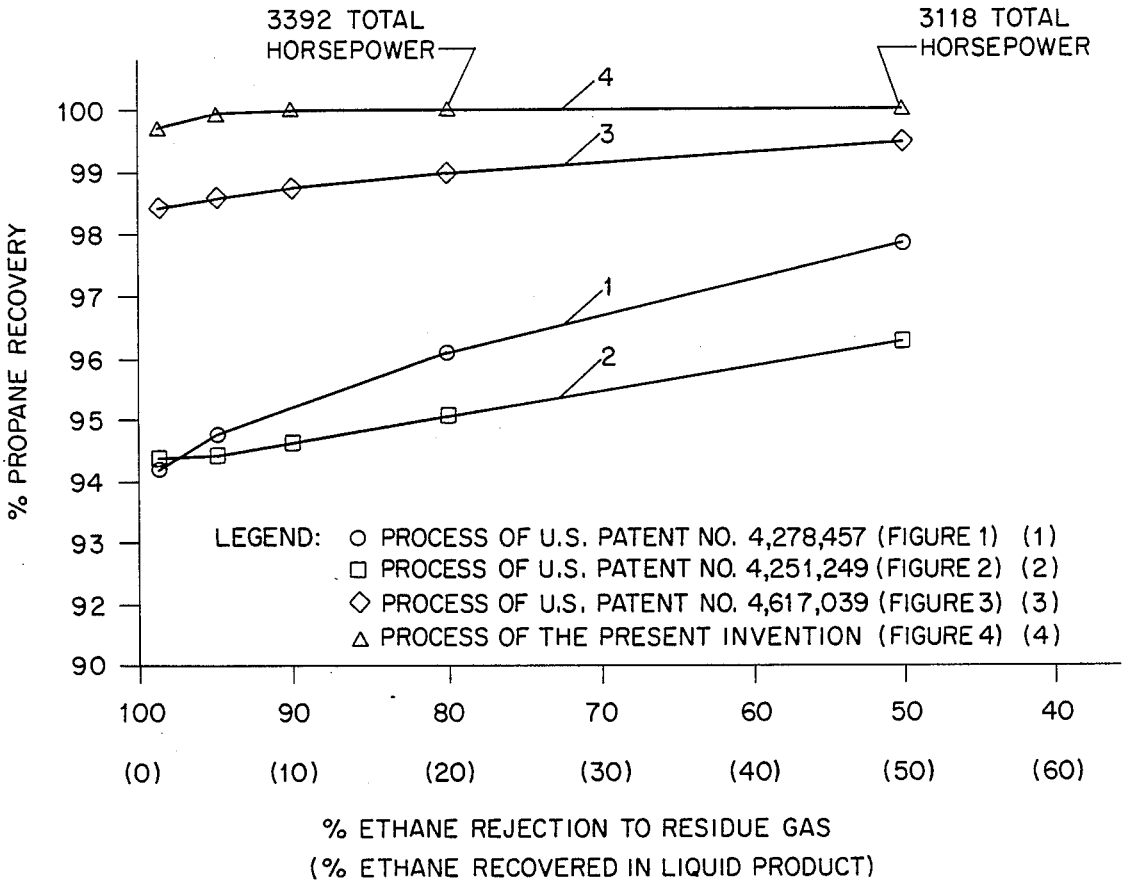
FIG. 5 is a plot showing the relative propane recovery as a function of ethane rejection for the processes of FIGS. 1 through 4.

The advantages of the present invention are further illustrated in the graph shown in FIG. 5. This graph indicates the relationship between the quantity of ethane rejected to the residue gas (abscissa) as a percent of the amount in the feed and the propane recovery (ordinate) for the processes of FIGS. 1 through 4. These plots are based on the same feed composition and conditions as used for the process comparisons given above and are based on a constant horsepower utilization of about 3678 horsepower, except as noted for individual points on the graph.

Line 1 on the graph corresponds to the process of FIG. 1 and shows that as the quantity of ethane rejected to the residue gas decreases from about 99 percent to 50 percent, the propane recovery increases from 94.3 percent to 97.8 percent. Line 2 corresponds to the process of FIG. 2 and shows that for the same range of ethane rejection, propane recovery increases from 94.3 percent to about 96.2 percent. Line 3 corresponds to the process of FIG. 3 and shows a propane recovery increase from 98.4 percent to 99.4 percent for the same ethane rejection range. Line 4 corresponds to the process of the present invention. This line shows that at an ethane rejection to the residue gas of 90 percent, essentially 100 percent propane recovery is achieved. Thereafter, as ethane rejection decreases, it is possible to maintain 100 percent propane recovery at reduced horsepower requirements. At 80 percent ethane rejection the horsepower requirement has dropped to 3392. At 50 percent ethane rejection the value is 3118 horsepower, more than 15 percent lower than for the other three processes.

It can be seen from FIG. 5 that incorporating the split flow reflux system of the present invention into the design of an NGL recovery plant provides considerable operating flexibility to respond to changes in the market for ethane. Any level of ethane rejection to the residue can be achieved while maintaining high propane recovery. This allows the plant operator to maximize operating income as the incremental value of ethane as a liquid (the gross selling price of ethane as a liquid less its value on a BTU basis as a constituent of the residue gas) changes.

At the same time, a process with the split flow reflux system can also be operated to attain relatively high ethane recoveries. As the ethane recovery is increased by reducing the temperature at the bottom of the column, the temperature difference between the flash expanded stream (stream **19*b* in FIG. 4) and the deethanizer overhead stream (stream 25 in FIG. 4**) decreases. As this temperature difference decreases, less cooling and condensation of the column overhead stream occurs resulting in less warming of the flash expanded stream and a colder temperature for this stream entering the column. The process of the present invention provides a means of obtaining maximum propane recovery at any given level of ethane rejection to the residue gas. If maximizing ethane recovery is desired, use of the process disclosed in co-pending application No. 194,822 should be considered.

Figure 10:
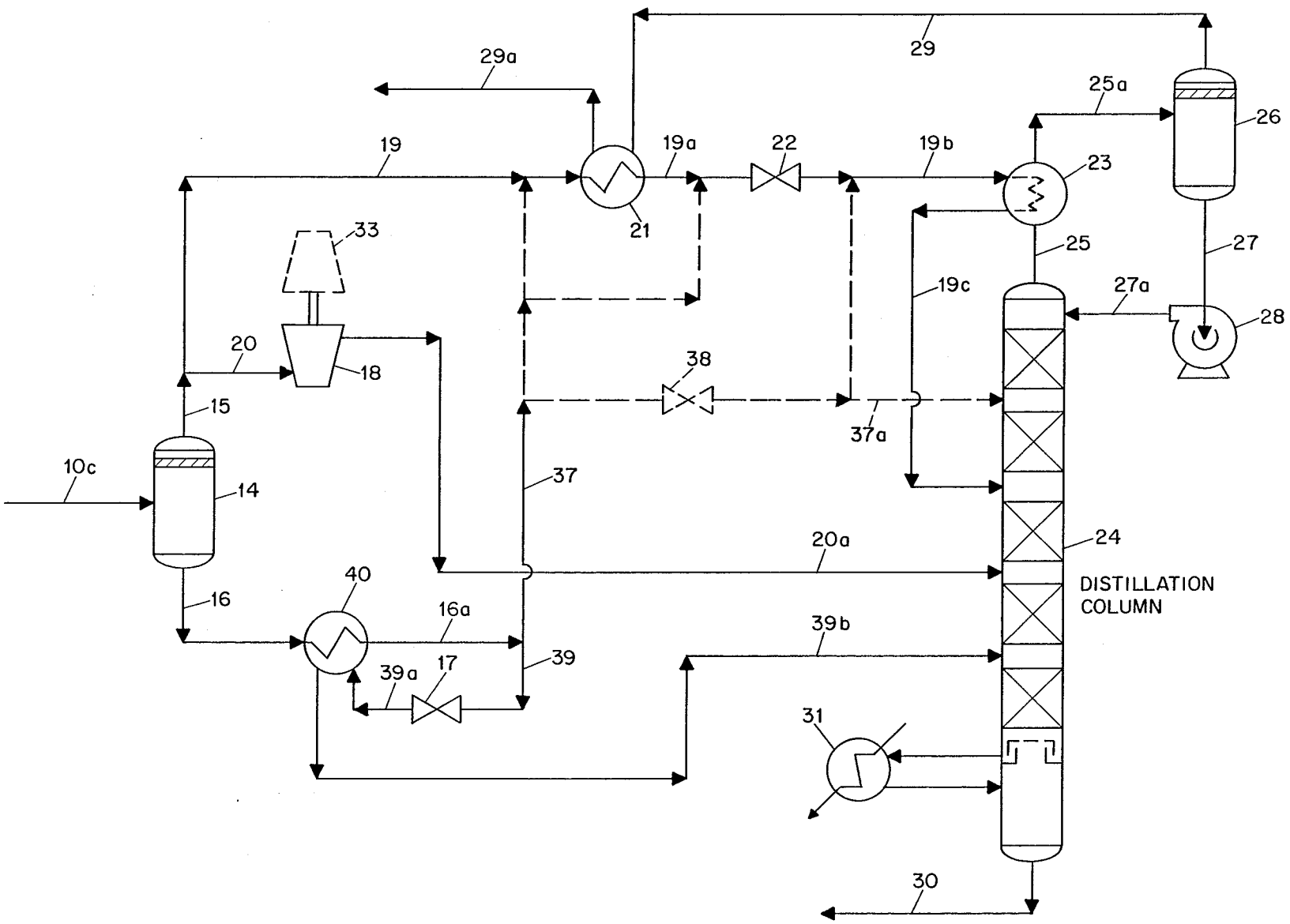
FIG. 10 is a partial flow diagram showing a natural gas processing plant in accordance with the present invention for a richer gas stream.

In instances where the inlet gas is richer than that heretofore described, an embodiment of the invention such as that depicted in FIG. 10 may be employed. Condensed stream 16 flows through exchanger 40 where it is subcooled by heat exchange with the cooled stream **39*a* from expansion valve 17. The subcooled liquid is then divided into two portions. The first portion (stream 39) flows through expansion valve 17 where it undergoes expansion for flash vaporization as the pressure is reduced to about the pressure of the distillation column. The cold stream 39*a* from expansion valve 17 then flows through exchanger 40 where it is used to subcool the liquids from separator 14. From exchanger 40 the stream 39*b* flows to distillation column 24 as a lower mid-column feed. The second liquid portion 37, still at high pressure, is (1) combined with portion 19 of the vapor stream from separator 14 or (2) combined with substantially condensed stream 19*a* or (3) expanded in expansion valve 38 and thereafter either supplied to the distillation column 24 at an upper mid-column feed position or combined with expanded stream 19*b*. Alternatively, portions of stream 37 may follow any or all of the flow paths heretofore described and depicted in FIG. 10**.

Figure 6:
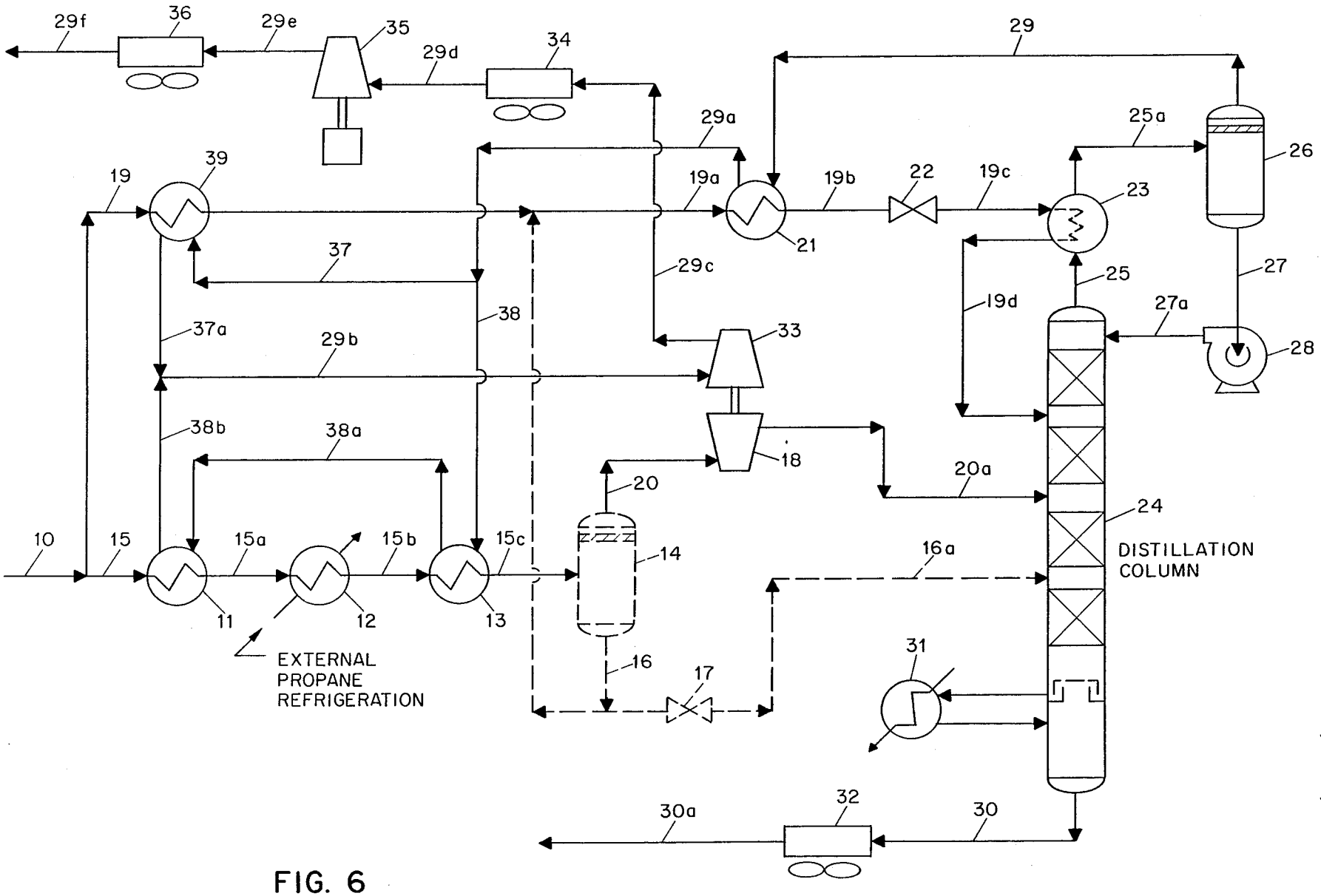
FIGS. 6 and 7 are flow diagrams of additional natural gas processing plants in accordance with the present invention.
Figure 7:
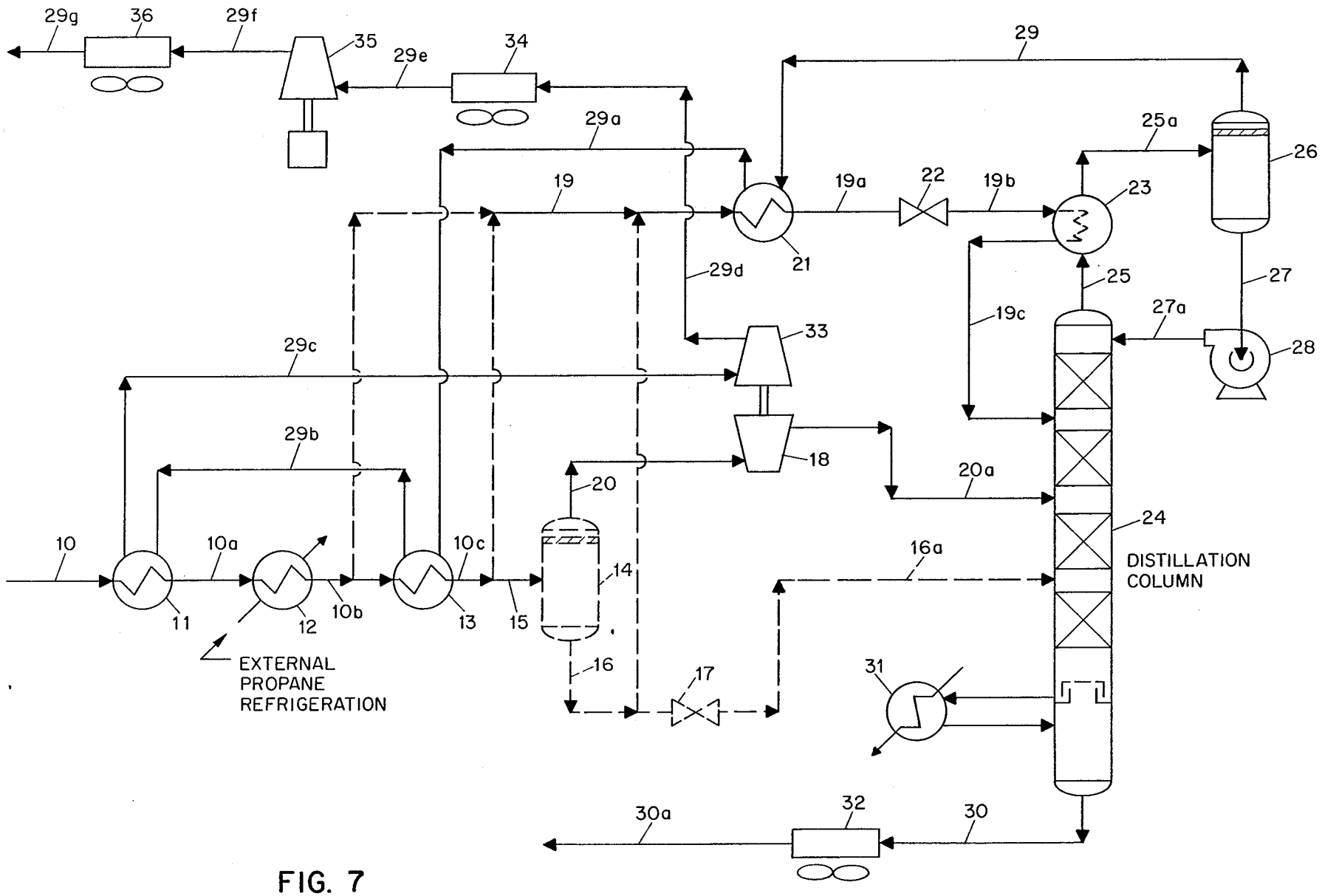

In accordance with this invention, the splitting of the vapor feed may be accomplished in several ways. In the process of FIG. 4, the splitting of the vapor occurs following cooling and separation of any liquids which may have been formed. However, the splitting of the vapor may be accomplished prior to any cooling of the gas as shown in FIG. 6 or after the cooling of the gas and prior to any separation stages as shown in FIG. 7. In some embodiments, vapor splitting may be effected in a separator. Alternatively, the separator 14 in the processes shown in FIGS. 6 and 7 may be unnecessary if the inlet gas is relatively lean. Where appropriate, the second stream 15 depicted in FIG. 7 may be cooled after division of the inlet stream and prior to expansion of the second stream.

It will also be recognized that the relative amount of feed flowing in each branch of the split vapor feed will depend on several factors, including feed gas pressure, feed gas composition, the amount of heat which can economically be extracted from the feed and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The first (upper mid-column), second (mid-column) and third (lower mid-column) feed positions depicted are the preferred feed locations for the process operating under the conditions described. However, the relative locations of the mid-column feeds may vary depending on inlet composition and other factors such as desired recovery levels and amount of liquid formed during inlet gas cooling. Moreover, two or more of the feed streams, or portions thereof, may be combined depending on the relative temperatures and quantities of the individual streams, and the combined stream(s) fed mid-column. The streams may be combined before or after expansion and/or cooling. For example, all or a part of stream 16 in FIG. 7 may be combined with stream 19 and the combined stream cooled in exchanger 21 and expanded in valve 22. FIG. 4 is the preferred embodiment for the composition and pressure conditions shown. Although individual stream expansion is depicted in particular expansion devices, alternative expansion means may be employed where appropriate. For example, conditions may warrant work expansion of the minor portion of the stream.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas containing methane, $C_2$ components, $C_3$ components and heavier hydrocarbon components into a volatile residue gas fraction containing a major portion of said methane and $C_2$ components and a relatively less volatile fraction containing a major portion of said $C_3$ components and heavier components, in which process (a) said gas is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier hydrocarbon components is recovered in said relatively less volatile fraction;

the improvement wherein said gas is cooled sufficiently to partially condense it; and (1) said partially condensed gas is separated thereby to provide a vapor stream and a condensed stream;

(2) said vapor stream is thereafter divided into gaseous first and second streams;

(3) said gaseous first stream is cooled to condense substantially all of it and is thereafter expanded to said lower pressure;

(4) the expanded cooled first stream is then directed in heat exchange relation with a warmer distillation stream which rises from fractionation stages of a distillation column;

(5) the distillation stream is cooled by said first stream sufficiently to partially condense it and said partially condensed distillation stream is separated thereby to provide said volatile residue gas and a reflux stream, said reflux stream is supplied to said distillation column at a top column feed position;

(6) the warmed first stream is supplied to said column at a first mid-column feed position;

(7) the gaseous second stream is expanded to said lower pressure and is supplied to said distillation column at a second mid-column feed position;

(8) said condensed stream is expanded to said lower pressure and is supplied to said distillation column at a third mid-column feed position; and (9) the temperatures of said feeds to the column are effective to maintain column overhead temperature at a temperature whereby the major portion of said $C_3$ components and heavier hydrocarbon components is recovered in said relatively less volatile fraction.

2. The improvement according to claim 1 wherein the distillation column is a lower portion of a fractionation tower and wherein (a) the distillation stream is cooled by the expanded cooled first stream and (b) the cooled distillation stream is separated to provide the volatile residue gas and the reflux stream in a portion of the tower above the distillation column and wherein said reflux stream flows to the top fractionation stage of the distillation column.

3. The improvement according to claim 1 wherein the reflux stream is directed through a pump to the distillation column.

4. The improvement according to claim 1 wherein the distillation stream is (a) cooled to partially condense it and (b) separated in a dephlegmator to provide said volatile residue gas and a reflux stream and wherein the reflux stream flows from the dephlegmator to the top fractionation stage of the distillation column.

5. In a process for the separation of a gas containing methane, $C_2$ components, $C_3$ components and heavier hydrocarbon components into a volatile residue gas fraction containing a major portion of said methane and $C_2$ components and a relatively less volatile fraction containing a major portion of said $C_3$ components and heavier components, in which process (a) said gas is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams and (1) said gaseous first stream is cooled to condense substantially all of it and is thereafter expanded to said lower pressure;

(2) said gaseous second stream is cooled under pressure and is thereafter expanded to said lower pressure;

(3) the expanded cooled first stream is directed in heat exchange relation with a warmer distillation stream which rises from fractionation stages of a distillation column;

(4) the distillation stream is cooled by said first stream sufficiently to partially condense it and said partially condensed distillation stream is separated thereby to provide said volatile residue gas and a reflux stream, said reflux stream is supplied to said distillation column at a top column feed position;

(5) the warmed first stream is then supplied to said distillation column at a first mid-column feed position;

(6) the expanded cooled second stream is supplied to said distillation column at a second mid-column feed position; and (7) the temperatures of said feeds to the column are effective to maintain column overhead temperature at a temperature whereby the major portion of said $C_3$ components and heavier hydrocarbon components is recovered in said relatively less volatile fraction.

6. The improvement according to claim 5 wherein the distillation column is a lower portion of a fractionation tower and wherein (a) the distillation stream is cooled by the expanded cooled first stream and (b) the cooled distillation stream is separated to provide the volatile residue gas and the reflux stream in a portion of the tower above the distillation column and wherein said reflux stream flows to the top fractionation stage of the distillation column.

7. The improvement according to claim 5 wherein the reflux stream is directed through a pump to the distillation column.

8. The improvement according to claim 5 wherein the distillation stream is (a) cooled to partially condense it and (b) separated in a dephlegmator to provide said volatile residue gas and reflux stream and wherein the reflux stream flows from the dephlegmator to the top fractionation stage of the distillation column.

9. The improvement according to claim 5 wherein the second stream is expanded to said lower pressure in a work expansion machine and wherein (a) prior to work expansion, said second stream is a partially condensed stream;

(b) said partially condensed second stream is separated thereby to provide a vapor stream and a condensed stream;

(c) said vapor stream is expanded in the work expansion machine and supplied to said distillation column at a second mid-column feed position; and (d) said condensed stream is expanded to said lower pressure and is supplied to said distillation column at a third mid-column feed position.

10. In a process for the separation of a gas containing methane, $C_2$ components, $C_3$ components and heavier hydrocarbon components into a volatile residue gas fraction containing a major portion of said methane and $C_2$ components and a relatively less volatile fraction containing a major portion of said $C_3$ components and heavier components, in which process (a) said gas is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier hydrocarbon components is recovered in said relatively less volatile fraction;

the improvement wherein following cooling, said cooled stream is divided into first and second streams and (1) said first stream is cooled to condense substantially all of it and is thereafter expanded to said lower pressure;

(2) said second stream is expanded to said lower pressure;

(3) the expanded cooled first stream is directed in heat exchange relation with a warmer distillation stream which rises from fractionation stages of a distillation column;

(4) the distillation stream is cooled by said first stream sufficiently to partially condense it and said partially condensed distillation stream is separated thereby to provide said volatile residue gas and a reflux stream, said reflux stream is supplied to said distillation column at a top column feed position;

(5) the warmed first stream is then supplied to said column at a first mid-column feed position;

(6) the expanded second stream is supplied to said distillation column at a second mid-column feed position; and (7) the temperatures of said feeds to the column are effective to maintain column overhead temperature at a temperature whereby the major portion of said $C_3$ components and heavier hydrocarbon components is recovered in said relatively less volatile fraction.

11. The improvement according to claim 10 wherein the distillation column is a lower portion of a fractionation tower and wherein (a) the distillation stream is cooled by the expanded cooled first stream and (b) the cooled distillation stream is separated to provide the volatile residue gas and the reflux stream in a portion of the tower above the distillation column and wherein said reflux stream flows to the top fractionation stage of the distillation column.

12. The improvement according to claim 10 wherein the reflux stream is directed through a pump to the distillation column.

13. The improvement according to claim 10 wherein the distillation stream is (a) cooled to partially condense it and (b) separated in a dephlegmator to provide said volatile residue gas and a reflux stream and wherein the reflux stream flows from the dephlegmator to the top fractionation stage of the distillation column.

14. The improvement according to claim 10 wherein the second stream is cooled after said division and prior to the expansion to said lower pressure.

15. The improvement according to claim 10 wherein the second stream is expanded to said lower pressure in a work expansion machine and wherein (a) prior to work expansion, said second stream is a partially condensed stream;

(b) said partially condensed second stream is separated thereby to provide a vapor stream and a condensed stream;

(c) said vapor stream is expanded in the work expansion machine and supplied to said distillation column at a second mid-column feed position; and (d) said condensed stream is expanded to said lower pressure and is supplied to said distillation column at a third mid-column feed position.

16. The improvement according to claim 1, 5 or 10 wherein the temperatures of said feeds to the column are effective to maintain column overhead temperature at a temperature whereby the major portion of said $C_2$ components, $C_3$ components and heavier hydrocarbon components is recovered in said relatively less volatile fraction.

17. The improvement according to claim 1, 9 or 15 wherein at least portions of at least two of said first stream, said second stream and said condensed stream are combined to form a combined stream and said combined stream is supplied to said column at a mid-column feed position.

18. The improvement according to claim 5 or 10 wherein at least portions of said first stream and said second stream are combined to form a combined stream and said combined stream is supplied to said column at a mid-column feed position.

19. The improvement according to claim 1, 9 or 15 wherein (a) said condensed stream is cooled and divided into first and second portions;
(b) said first portion is expanded to said lower pressure and supplied to said column at a mid-column feed position; and
(c) the second portion is supplied to said column at a higher mid-column feed position.

20. The improvement according to claim 19 wherein
(a) at least part of said second portion is combined with said first stream to form a combined stream and said combined stream is directed in heat exchange relation with said distillation stream and then supplied to said column at a mid-column feed position; and
(b) the remainder of said second portion is expanded to said lower pressure and supplied to said column at another mid-column feed position.

21. The improvement according to claim 19 wherein the first portion is expanded, directed in heat exchange relation with said condensed stream and then supplied to said column at a lower mid-column feed position.

22. The improvement according to claim 19 wherein said second portion is expanded to said lower pressure and at least part of said expanded second portion is combined with said expanded cooled first stream to form a combined stream and said combined stream is directed in heat exchange relation with said distillation stream and then supplied to said column at a mid-column feed position.

23. In an apparatus for the separation of a gas containing methane, $C_2$ components, $C_3$ components and heavier hydrocarbons into a volatile residue gas fraction containing a major portion of said methane and $C_2$ components and a relatively less volatile fraction containing a major portion of said $C_3$ components and heavier components, in said apparatus there being
(a) a first cooling means to cool said gas under pressure connected to provide a cooled stream under pressure;
(b) a first expansion means connected to receive at least a portion of said cooled stream under pressure and to expand it to a lower pressure, whereby said stream is further cooled; and
(c) a distillation column connected to said first expansion means to receive the further cooled stream therefrom;
the improvement wherein said apparatus includes
(1) first cooling means adapted to cool said feed gas under pressure sufficiently to partially condense it;
(2) first separation means connected to said first cooling means to receive said partially condensed feed and to separate it into a vapor and a condensed stream;
(3) dividing means connected to said first separation means to receive said vapor and to divide said vapor into first and second streams;
(4) second cooling means connected to said dividing means to receive said first stream and to cool it sufficiently to substantially condense it;
(5) second expansion means connected to said second cooling means to receive said substantially condensed first stream and to expand it to said lower pressure;
(6) heat exchange means connected to said second expansion means to receive said expanded first stream and to heat it, said heat exchange means being further connected to said distillation column (a) at a first mid-column feed position to supply said heated first stream to said distillation column and (b) at a point to receive a distillation stream rising from fractionation stages of the distillation column and to cool and partially condense said distillation stream; said heat exchange means being further connected to second separation means;
(7) said second separation means being connected to said heat exchange means to receive said partially condensed distillation stream and to separate it into said volatile residue gas fraction and a reflux stream, said second separation means being further connected to said distillation column to supply said reflux stream to the distillation column at a top column feed position;
(8) first expansion means connected to said dividing means to receive said second stream and expand it to said lower pressure, said first expansion means being further connected to said distillation column to supply said expanded stream to said column at a second mid-column feed position;
(9) third expansion means connected to said first separation means to receive the condensed stream from said first separation means and to expand it to said lower pressure; said third expansion being further connected to said distillation column to supply said condensed stream to said column at a third mid-column feed position; and
(10) control means adapted to regulate the temperatures of said first stream, said second stream, said reflux stream and said condensed stream to maintain column overhead temperature at a temperature whereby the major portion of said $C_3$ components and heavier components is recovered in said relatively less volatile fraction.

24. In an apparatus for the separation of a feed gas containing methane, $C_2$ components, $C_3$ components and heavier hydrocarbon components into a volatile residue gas fraction containing a major portion of said methane and $C_2$ components and a relatively less volatile fraction containing a major portion of said $C_3$ components and heavier components; in said apparatus there being
(a) a first cooling means to cool said gas under pressure connected to provide a cooled stream under pressure;
(b) a first expansion means connected to receive at least a portion of said cooled stream under pressure and to expand it to a lower pressure, whereby said stream is further cooled; and
(c) a distillation column connected to said expansion means to receive the further cooled stream therefrom;
the improvement wherein said apparatus includes
(1) dividing means prior to said first cooling means to divide said feed gas into a first gaseous stream and a second gaseous stream;
(2) second cooling means connected to said dividing means to receive said first stream and to cool it sufficiently to substantially condense it;
(3) second expansion means connected to said second cooling means to receive the substantially condensed first stream therefrom and to expand it to said lower pressure;
(4) heat exchange means connected to said second expansion means to receive said expanded first stream and to heat it, said heat exchange means being further connected to said distillation column (a) at a first mid-column feed position to supply said heated first stream to said column and (b) at a point to receive a distillation stream rising from fractionation stages of the distillation column wherein said heat exchange means cools and partially condenses said distillation stream; said heat exchange means being further connected to separation means;

(5) said separation means being connected to said heat exchange means to receive said partially condensed distillation stream and to separate it into said residue gas fraction and a reflux stream, said separation means being further connected to said distillation column to supply said reflux stream to the distillation colmn at a top column feed position;

(6) said first cooling means being connected to said dividing means to receive said second stream and to cool it;

(7) said first expansion means being connected to said first cooling means to receive said cooled second stream and to expand and further cool it; said first expansion means being further connected to said distillation column to supply said second stream to the column at a second mid-column feed position; and (8) control means adapted to regulate the temperatures of said first stream, said second stream and said reflux stream to maintain column overhead temperature at a temperature whereby the major portion of said $C_3$ components and heavier components is recovered in said relatively less volatile fraction.

25. In an apparatus for the separation of a gas containing methane, $C_2$ components, $C_3$ components and heavier hydrocarbon components into a volatile residue gas fraction containing a major portion of said methane and $C_2$ components and a relatively less volatile fraction containing a major portion of said $C_3$ components and heavier components; in said apparatus there being (a) a first cooling means to cool said gas undr pressure connected to provide a cooled stream under pressure;

(b) a first expansion means connected to receive at least a portion of said cooled stream under pressure and to expand it to a lower pressure, whereby said stream is further cooled; and (c) a distillation column connected to said expansion means to receive the further cooled stream therefrom;

the improvement wherein said apparatus includes (1) dividing means after said first cooling means to divide said cooled stream into a first stream and a second stream;

(2) second cooling means connected to said dividing means to receive said first stream and to cool it sufficiently to substantially condense it;

(3) second expansion means connected to said second cooling means to receive the substantially condensed first stream therefrom and to expand it to said lower pressure;

(4) heat exchange means connected to said second expansion means to receive said expanded first stream and to heat it, said heat exchange means being further connected to said distillation column (a) at a first mid-column feed position to supply said heated first stream to said distillation column and (b) at a point to receive a distillation stream rising from fractionation stages of the distillation column wherein said heat exchange means cools and partially condenses said distillation stream; said heat exchange means being further connected to separation means;

(5) said separation means being connected to said heat exchange means to receive said partially condensed distillation stream and to separate it into said volatile residue gas fraction and a reflux stream, said separation means being further connected to said distillation column to supply said reflux stream to the distillation column at a top column feed position;

(6) said first expansion means being connected to said dividing means to receive said second stream and to expand and cool it; said first expansion means being further connected to said distillation column to supply said second stream to the column at a second mid-column feed position; and (7) control means adapted to regulate the temperatures of said first stream, said second stream and said reflux stream to maintain column overhead temperature at a temperature whereby the major portion of said $C_3$ components and heavier components is recovered in said relatively less volatile fraction.

26. The improvement according to claim 23, 24 or 25 wherein the distillation column is a lower portion of a fractionation tower and wherein the distillation stream is cooled and the cooled distillation stream is separated in a portion of the tower above the distillation column.

27. The improvement according to claim 23, 24 or 25 wherein a dephlegmator is connected to said second expansion means to receive said expanded first stream and to provide for the heating of said expanded first stream, said dephlegmator being further connected to said distillation column (a) at a top column feed position to supply said heated first stream to said distillation column and (b) at a point to (i) receive a distillation stream rising from fractionation stages of the distillation column whereby said expanded first stream cools and partially condenses said distillation stream as said expanded first stream is heated and whereby said partially condensed distillation stream is separated to provide said volatile residue gas and said reflux stream; and (ii) supply the reflux stream formed in the dephlegmator to the top fractionation stage of the distillation column.

28. The improvement according to claim 23, 24 or 25 wherein the apparatus includes control means adapted to regulate the temperatures of said feeds to the column to maintain column overhead temperature at a temperature whereby the major portion of said $C_2$ components, $C_3$ components and heavier hydrocarbon components is recovered in said relatively less volatile fraction.

* * * * *

UNITED STATES PATENT AND TRADEMARK OFFICE

CERTIFICATE OF CORRECTION

PATENT NO. : 4,854,955

DATED : August 8, 1989

INVENTOR(S) : Campbell et al.

It is certified that error appears in the above-identified patent and that said Letters Patent is hereby corrected as shown below:

Col. 5, line 5, "The residue ..." should begin a new paragraph;

Col. 6, line 37, "-120°F." should read --120°F.--;

Col. 7, line 31, "19 This" should read --19. The --;

Col. 7, line 44, "20a" should read --20a)--;

Col. 8, line 40, "-5°F." should read --5°F.--;

Col. 8, line 41, "-2°F." should read --2°F.--

Col. 8, line 53, "seprrator" should read --separator--;

Col. 9 line 36, "-120°F." should read --120°F.--;

UNITED STATES PATENT AND TRADEMARK OFFICE

CERTIFICATE OF CORRECTION

PATENT NO. : 4,854,955

DATED : August 8, 1989

INVENTOR(S) : Campbell et al.

It is certified that error appears in the above-identified patent and that said Letters Patent is hereby corrected as shown below:

Col. 10, line 48, "vaporliquid" should read --vapor-liquid--;

Col. 10, line 55, "-197°F.--; should read --197°F.--;

Col. 19, line 14, "colmn" should read --column--;

Col. 19, line 39, "undr" should read --under--.

Signed and Sealed this

Seventeenth Day of July, 1990

*Attest:*

*Attesting Officer*

HARRY F. MANBECK, JR.

*Commissioner of Patents and Trademarks*